US008138421B2

(12) United States Patent
Takamatsu et al.

(10) Patent No.: US 8,138,421 B2
(45) Date of Patent: Mar. 20, 2012

(54) FLAT CABLE

(75) Inventors: Hiroshi Takamatsu, Tochigi (JP); Tetsuji Kojima, Tochigi (JP)

(73) Assignee: Sony Chemical & Information Device Corporation, Tokyo (JP)

( * ) Notice: Subject to any disclaimer, the term of this patent is extended or adjusted under 35 U.S.C. 154(b) by 295 days.

(21) Appl. No.: 12/593,786

(22) PCT Filed: Mar. 7, 2008

(86) PCT No.: PCT/JP2008/054187

§ 371 (c)(1),
(2), (4) Date: Sep. 29, 2009

(87) PCT Pub. No.: WO2008/126537

PCT Pub. Date: Oct. 23, 2008

(65) Prior Publication Data

US 2010/0044077 A1 Feb. 25, 2010

(30) Foreign Application Priority Data

Mar. 30, 2007 (JP) ..... 2007-090802
Jan. 22, 2008 (JP) ..... 2008-011152

(51) Int. Cl.
*H01B 7/08* (2006.01)

(52) U.S. Cl. ..... 174/117 F; 174/117 FF

(58) Field of Classification Search ..... 174/117 F, 174/117 FF

See application file for complete search history.

(56) References Cited

U.S. PATENT DOCUMENTS 3,459,877 A * 8/1969 Bullock et al. ..... 174/107
4,595,414 A * 6/1986 Shutt ..... 106/18.16
5,455,383 A * 10/1995 Tanaka ..... 174/36
5,658,164 A * 8/1997 Parker ..... 439/495
2004/0185736 A1* 9/2004 Curro et al. ..... 442/336
2007/0193770 A1* 8/2007 Ueno et al. ..... 174/117 FF

FOREIGN PATENT DOCUMENTS

| | | |
|---|---|---|
| JP | 60-89006 | 5/1985 |
| JP | 61-127514 | 8/1986 |
| JP | 11-306869 | 11/1999 |
| JP | 2000-138426 | 5/2000 |
| JP | 2001-336669 | 12/2001 |
| JP | 2002-100842 | 4/2002 |
| JP | 2003-031033 | 1/2003 |
| JP | 2005-251958 | 9/2005 |

OTHER PUBLICATIONS

International Search Report dated Jun. 24, 2008, for corresponding Patent Application PCT/JP2008/054187.

* cited by examiner

*Primary Examiner* — Chau Nguyen
(74) *Attorney, Agent, or Firm* — K&L Gates LLP

(57) ABSTRACT

A flexible flat cable capable of having good flexibility and good bending strength while reducing a thickness thereof without damaging a good electrical characteristic of a strip structure and capable of enhancing cost effectiveness is provided. The flexible flat cable includes: an air-containing layer, serving as an insulating member, having a width substantially the same as a transmission path width of a cable body including a plurality of conductors arranged in a prescribed pitch, the air-containing layer being disposed in such a manner as to sandwich the cable body from both sides; and shield members disposed in such a manner as to cover a surface of the air-containing layer and to be conductively connected to a ground layer at terminal portions of both ends of the cable body. The air-containing layer includes non-woven fabrics cut in a width substantially the same as the transmission path width of the cable body.

21 Claims, 9 Drawing Sheets

FLAT CABLE

CROSS REFERENCE TO RELATED APPLICATIONS

The present application is a National Stage of International Application No. PCT/JP2008/054187 filed on Mar. 7, 2008 and which claims priority to Japanese Patent Application No. P2007/090802 filed on Mar. 30, 2007 and Japanese Patent Application No. P2008/011152 filed on Jan. 22, 2008, the entire contents of which are being incorporated herein by reference.

BACKGROUND

The present disclosure relates to a flat cable serving as an interconnecting cable for various components disposed inside various electronic devices.

Related art electronic devices such as a personal computer, a flat-screen television set, a printer, and a scanner often employ a flat cable serving as an interconnecting cable for various components disposed therein. A flexible printed circuit board type of the flat cable is produced by an etching method. However, such a type of the flat cable is costly, and a length thereof cannot be greater than 1,000 mm due to a manufacturing infrastructure, causing difficulty in being applied to the increasing size of the flat-screen television set.

A flexible flat cable produced by a laminating method, on the other hand, has attracted attention as a substitute for the flexible printed circuit board type of the flat cable. The flexible flat cable has good flexibility and can be used in a pivotable portion. Moreover, the production cost and the unit price of the flexible flat cable are lower than those of the flexible printed circuit board type. Accordingly, the flexible flat cable tends to be applied to a wide variety of fields.

Conventionally, the flexible flat cable is not demanded to have an electrical characteristic such as a characteristic impedance. For example, a prior art flexible flat cable is provided by sandwiching a central conductor 101 from both sides by a base film 103 and laminating the base film 103 sandwiching the central conductor 101, so that both sides of the base films 103 are adhered as illustrated in FIG. 8. Such a prior art flexible flat cable is supposed to satisfy specifications needed. Herein, the base film 103 is, for example, made of polyethylene terephthalate, and includes a prescribed adhesion layer 102 applied thereto.

A flat cable of recent years, on the other hand, is demanded to increase the signal transmission speed with the development of various electronic devices such as a notebook personal computer and a flat-screen television set having high definition image quality. Moreover, the increase in the signal transmission speed is technically necessary for other electronic devices with the advance of digitization.

Such an increase in the signal transmission speed is in need of controlling the characteristic impedance of the cable. Accordingly, an impedance control cable in which the characteristic impedance is controlled is expected not only to enhance the capabilities thereof but also to be produced at a low price.

A flat type of the impedance control cable with a microstrip structure is illustrated in FIG. 9, and another flat type of the impedance control cable with a strip structure is illustrated in FIG. 10. In the impedance control cable with the microstrip structure, for example, a ground 203 is positioned on one surface of a transmission path formed of a conductor 201 and a dielectric substance 202 as illustrated in FIG. 9. In the impedance control cable with the strip structure, for example, a ground 303 is positioned on both surfaces of the transmission path formed of a conductor 301 and a dielectric substance 302 as illustrated in FIG. 10. The impedance control cables with the microstrip structure and the strip structure are already introduced in a market. Particularly, the impedance control cable with the microstrip structure is already employed in a certain flat-screen television set.

Such a flexible flat cable capable of controlling the characteristic impedance is illustrated in FIG. 11. A periphery of a central conductor 401 is covered with a dielectric substance 402, and a periphery of the dielectric substance 402 is covered with an outer conductor 403 as illustrated in FIG. 11, thereby forming the flexible flat cable capable of controlling the characteristic impedance. Such a flexible flat cable attracts attention as a substitute for an extra-fine coaxial cable of a high-end model from a low cost standpoint.

For example, Patent Document 1 discloses a flexible flat cable with a technology attempting to control the characteristic impedance thereof.

Patent Document 1: Japanese Unexamined Patent Application Publication No. 2003-31033

Particularly, Patent Document 1 discloses a flexible flat cable including: a conductor line formed of a plurality of conductors arranged in parallel; a foam insulator including an adhesive layer sandwiching the conductor line from both sides and then being laminated; and a metal layer including a conductive adhesive layer sandwiching the foam insulator including the adhesive layer from both sides. The conductor line is sandwiched by the foam insulator from both sides, and then the foam insulator sandwiching the conductor line is laminated, so that a dielectric constant of the foam insulator is combined with that of the air, allowing the dielectric constant to be lower than that of a related art insulator having no foam in a complex dielectric constant. Therefore, an electrostatic capacity of the character impedance is controlled, thereby setting the character impedance to be 50Ω. In such a flexible flat cable, a thickness of the foam insulator is relatively high, for example, between 150 μm and 250 μm, and an aluminum foil and a base film are laminated to serve as the metal layer including the conductive adhesive layer.

A signal transmission cable generally deteriorates, for example, noise resistance thereof as signal transmission speed increases. Accordingly, the signal transmission cable is demanded to be capable of handling the high-speed transmission. However, the increase in the signal transmission speed causes a problem of unnecessary radiation, or namely electromagnetic interface (EMI). That is, leakage of electromagnetic interface noise (radio wave) cannot be tolerated as the signal becomes a high frequency in the signal transmission. Such a leaked noise is provided to, for example, a cable adjacent to the signal transmission cable, causing adverse influence such as malfunctions and transmission losses.

The leakage of the noise can be reduced by sealing a noise source with a metal film. In this regard, the flexible flat cable with the microstrip structure including the ground 203 disposed on one surface of the transmission path is not expected to control the radiation with respect to a surface opposite to a surface on which the ground 203 is disposed as illustrated in FIG. 12. Consequently, the flexible flat cable with such a microstrip structure has a problem of controlling the radiation, causing a decrease in the likelihood of being employed in a case of being mounted in a product.

In the flexible flat cable with the strip structure as illustrated in FIG. 13, on the other hand, the ground 303 on the both surfaces serve as a shield layer, thereby being appropriate for controlling the radiation. However, the shield layer does not control an electrical characteristic. The ground 303 is positioned on the both surfaces of the transmission path, so that bonding strength of the transmission path and the ground 303 is increased, causing a problem of lowering the impedance. Consequently, such a type of the cable reduces the occurrences of lowering the impedance by methods for, for example, narrowing a width of the transmission path, lowering the dielectric constant of the dielectric substance, and widening space between the transmission path and the ground by an increase in a thickness of the dielectric substance.

Herein, since a feasible transmission path with or a feasible dielectric constant is limited, the method for widening the space between the transmission path and the ground is mainly employed among the methods to reduce the occurrence of lowering the impedance in the flexible flat cable with the strip structure. Accordingly, such a type of the flexible flat cable increases the thickness thereof, causing reduction of flexibility thereof. Consequently, the flexible flat cable has a problem of being not wired in a flexible manner inside an electronic device mounted. The flexible flat cable is preferably formed in thin from a standpoint of stress applied in the course of bending thereof. Such problems are attributed to the strip structure, and a number of manufacturing companies have attempted to solve such problems. However, a flexible flat cable satisfying the electric characteristics is not yet manufactured, and an increase in a cost by complication of a manufacturing method is currently concerned.

SUMMARY

The present embodiments to provide a flat cable capable of not only having good flexibility and a good bending strength in a thin shape but also enhancing cost effectiveness without damaging a good electrical characteristic of a strip structure.

The flat cable according to the present invention is uniquely provided by focusing on an influence on a characteristic impedance exerted by a thickness and a dielectric constant of an insulating member and by finding an appropriate material capable of having the good flexibility and the good bending strength while controlling the electronic characteristic.

Therefore, the flat cable according to the embodiment includes: an air-containing layer, serving as an insulating member, having a width substantially the same as a transmission path width of a cable body including a plurality of conductors arranged with a prescribed pitch therebetween, the air-containing layer being disposed in such a manner as to sandwich the cable body from both sides; and a shield member disposed in such a manner as to cover a surface of the air-containing layer and to be conductively connected to a ground layer at terminal portions of both ends of the cable body. The air-containing layer includes a non-woven fabric cut in a width substantially the same as the transmission path width of the cable body.

The flat cable according to the embodiment employs the non-woven fabric serving as the air-containing layer functioning as the insulating member, so that a thickness thereof can be reduced compared to a case of employing an insulating member made of resin, thereby providing the good flexibility and a good bending strength.

Moreover, the flat cable according to the embodiment can optionally adjust a dielectric constant by changing a width and a thickness of the conductor and a thickness of the non-woven fabric, thereby controlling a characteristic impedance.

The flat cable according to the embodiment includes the non-woven fabric having flame-resistance.

According to the embodiment, the flat cable having the good flexibility and good bending strength while reducing a thickness thereof without damaging the good electrical characteristic of the strip structure can be produced at a low price using existing equipment.

Additional features and advantages are described herein, and will be apparent from, the following Detailed Description and the figures.

DETAILED DESCRIPTION

Hereinafter, an embodiment will be described in detail with reference to the drawings.

According to the embodiment, a flexible flat cable (FFC) serves as an interconnecting cable for various components disposed inside various electronic devices. Particularly, the flexible flat cable optionally adjusts a dielectric constant by having an air-containing layer on a transmission path and a dielectric substance thereof and controls a characteristic impedance to solve a problem relating to flexibility of a flat cable with a strip structure.

Figure 1:
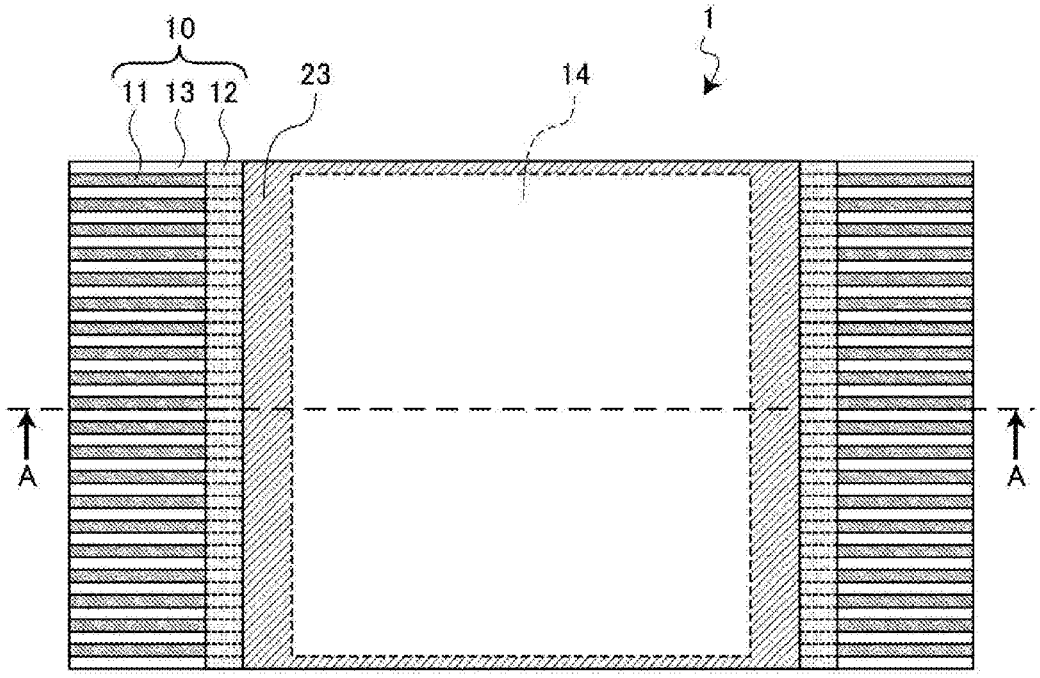
FIG. 1 is a schematic plan view illustrating a flexible flat cable according to an embodiment.
Figure 2:
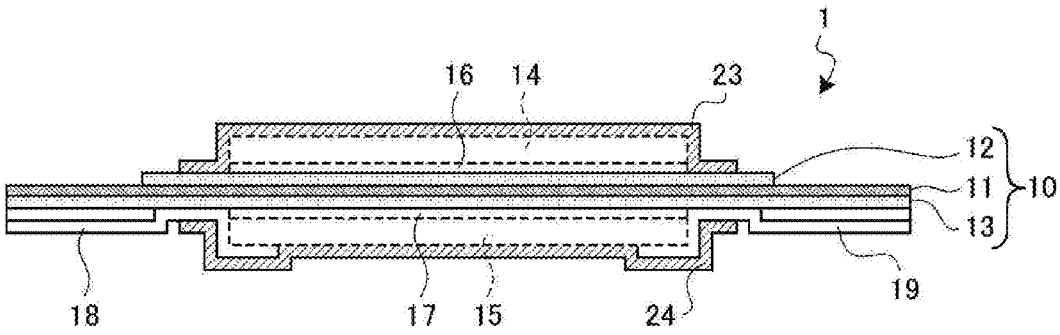
FIG. 2 is a cross-sectional view illustrating the flexible flat cable taken along line A-A of FIG. 1 according to the embodiment.

Referring to FIG. 1 and FIG. 2, a flexible flat cable 1 according to the embodiment is illustrated in a schematic diagram and a cross-sectional view, respectively. FIG. 2 illustrates the flexible flat cable 1 taken along a line A-A of FIG. 1. The flexible flat cable 1 includes a cable body 10 as illustrated in FIG. 1. The cable body 10 is formed by sandwiching a plurality of conductors 11 from both sides by a first insulating member 12 and a second insulating member 13 in a state that the conductors 11 are arranged in parallel with a prescribed pitch therebetween, and being laminated. Herein, each of the first and second insulating members 12, 13 includes a prescribed adhesive layer. That is, the cable body 10 serves as a cable with the strip structure. Each of the conductors 11 can be made of soft copper plated with tin on a surface thereof, for example. Each of the first and second insulating members 12, 13, for example, can be formed by laminating the prescribed insulating adhesive layer on a low dielectric member made of polyethylene terephthalate having holes. The insulating adhesive layer can be made of, for example, epoxy resin, acrylic resin, melamine resin, polyamide resin, and polyimide resin serving as binder resin. Particularly, the insulating adhesive layer is preferably made of the epoxy resin or acrylic resin serving as the binder resin from an adhesive strength standpoint or an availability standpoint.

The cable body 10 thus formed is sandwiched between a first non-woven fabric 14 and a second non-woven fabric 15 from both sides. Herein, each of the first and second non-woven fabrics 14, 15 serves as the air-containing layer having a width substantially the same as that of the transmission path of the cable body 10. Each of the first and second non-woven fabrics 14, 15 is cut in a width substantially the same as that of the transmission path of the cable body 10 and is provided in a state that the first and second non-woven fabrics 14, 15 are respectively adhered to double-sided adhesive layers 16, 17. Herein, each of the double-sided adhesive layers 16, 17 is, for example, double-sided adhesive tape. Consequently, the first and second non-woven fabrics 14, 15 are adhered to the cable body 10 through the respective double-sided adhesive layers 16, 17, thereby functioning as insulating members. Each of the first and second non-woven fabrics 14, 15 preferably has flame-resistance on practical base and good heat resistance to respond to possible fire caused by an increase in a heat amount with an increase in circuit density of the electronic device on which the flexible flat cable is mounted. Each of such first and second non-woven fabrics 14, 15 can be made of a fiber material, for example, cellulose, polyester, aramid, and polyimide impregnated with a flame-resistant agent. Particularly, the cellulose material or aromatic aramid material impregnated with the flame-resistant agent is preferred from a heat-resistance standpoint or a flame-resistance standpoint.

Figure 3:
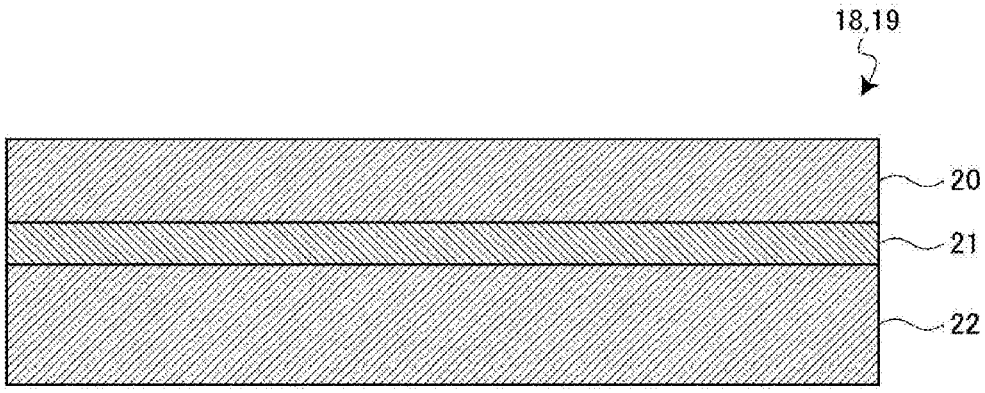
FIG. 3 is a schematic cross-sectional view illustrating a first ground foil and a second ground foil disposed in the flexible flat cable according to the embodiment.

Moreover, the flexible flat cable 1 includes a first ground foil 18 and a second ground foil 19 forming a ground layer disposed at both ends of terminal portions of the cable body 10. For example, each of the first ground foil 18 and the second ground foil 19 is formed by laminating a metal layer 20 and an acrylic adhesive layer 21 as illustrated in FIG. 3. Each of the first ground foil 18 and the second ground foil 19 is provided in a state that a release sheet 22 is adhered to a bottom layer of the acrylic adhesive layer 21. The metal layer 20 can be made of any metal having good conductivity such as gold, silver, copper, and lead. Particularly, the metal layer 20 is preferably made of the copper or aluminum from an electrical characteristic standpoint or an availability standpoint. The acrylic adhesive layer 21 can be made of acrylate, for example, monofunctional acrylate and polyfunctional acrylate such as bifunctional acrylate, and trifunctional acrylate. The acrylic adhesive layer 21 can be made of one of such acrylate or by mixing two or more such acrylate resins. Each of the first ground foil 18 and the second ground foil 19 is adhered from end potions of the first and second non-woven fabrics 14, 15 to the terminal portions of the cable body 10 through the acrylic adhesive layer 21 exposed by releasing the release sheet 22.

Moreover, the flexible flat cable 1 includes a first shield member 23 and a second shield member 24 deposed in such a manner as to cover the first and second non-woven fabrics 14, 15, respectively. Each of the first and second shield members 23, 24 is formed of a conductive adhesive layer 27 disposed to a bottom layer of a vapor-deposited silver shield member formed by vapor deposition of a silver layer 26 to the polyethylene terephthalate film 25, for example. Herein, the polyethylene terephthalate film 25 and the silver layer 26 respectively serve as a base film and a shield layer, and the conductive adhesive layer 27 is, for example, an anisotropic conductive film (ACF) or an anisotropic conductive paste (ACP). Each of the first and second shield members 23, 24 is adhered in such a manner as to be conductively connected to the first and second ground foils 18, 19 through the conductive adhesive layer 27 thereof. Therefore, each of the first and second shield members 23, 24 also functions as ground. Herein, the vapor-deposited silver shield member formed by vapor deposition of the silver layer 26 is used. However, each of the first and second shield members 23, 24 can be made of any metal having good conductivity such as gold, silver, copper, and lead. Particularly, the silver or aluminum is preferred from the electrical characteristic standpoint or the availability standpoint. The conductive adhesive layer 27 can be made of, for example, epoxy resin, acrylic resin, melamine resin, polyamide resin, and polyimide resin serving as binder resin. Particularly, the epoxy resin or acrylic resin serving as the binder resin is preferred from the adhesive strength standpoint or the availability standpoint.

The flexible flat cable 1 employs the first and second non-woven fabrics 14, 15 each of which serves as the insulating member, so that a thickness thereof can be reduced compared to a case of employing an insulating member made of resin, thereby providing the good flexibility.

The flexible flat cable 1 employs the first and second non-woven fabrics 14, 15 instead of the insulating member made of resin, thereby enhancing the resistance to the stress applied in the course of bending.

Moreover, the flexible flat cable 1 optionally adjusts the dielectric constant by changing a width and a thickness of the conductor 11 and a thickness of each of the first and second non-woven fabrics 14, 15, thereby controlling the characteristic impedance while not damaging the good electrical characteristic of the strip structure. Herein, the electrical characteristic, for example, includes a transmission loss, an eye pattern aperture ratio, and electromagnetic interface (EMI).

Moreover, the flexible flat cable 1 can enhance the flame-resistance thereof by employing the first and second non-woven fabrics 14, 15 having flame-resistance.

The flexible flat cable 1 can be produced by heat lamination as similar to an existing production process. In a case where an insulating member is made of resin as a conventional manner, a cable is difficult to be produced by the heat lamination due to a property of the resin made insulating member and needs to be pressed with heat (heat-press). Since the heat-press is performed as a singulation or batch process, productivity or production cost is affected, causing not following a market demand. The flexible flat cable 1, on the other hand, can be produced by the heat lamination, thereby enhancing productivity and reducing the production cost. Since the flexible flat cable 1 can be produced by the heat lamination, a length thereof can be easily extended to, for example, approximately 1.5 m, thereby providing a high yield rate.

The flexible flat cable 1 can be produced with a low-priced material using the existing production process. Therefore, the flexible flat cable 1 can be produced at a low price using existing equipment, thereby enhancing the cost effectiveness.

Therefore, the flexible flat cable 1 is suitable for the various electronic devices in need of high-speed signal transmission. The electronic devices, for example, include a notebook personal computer and a flat-screen television set in which high definition image transmission is demanded.

EXAMPLES

Hereinafter, a particular example of a flexible flat cable according to the embodiment will be described based on an experimental result.

Figure 5:
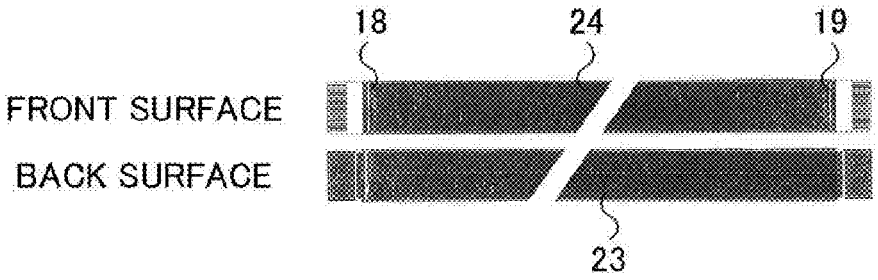
FIG. 5 is a plan view illustrating a prototype flexible flat cable according to a first example.

A prototype flexible flat cable as illustrated in FIG. 5 was produced by the inventors of the present invention using materials with specifications as illustrated in Tables 1, 2. Such materials as illustrated in Tables 1, 2 were used to serve as the conductor 11, the first and second insulating members 12, 13, the first and second non-woven fabrics 14, 15, the first and second ground foils 18, 19, and the first and second shield members 23, 24.

TABLE 1

| MATERIAL | SPECIFICATION |
|---|---|
| CONDUCTOR | TIN-PLATED SOFT COPPER WIDTH OF 0.25 mm × THICKNESS OF 0.040 mm |
| INSULATOR | F2100 AVAILABLE FROM SONY CHEMICAL & INFORMATION DEVICE CORP. POLYETHYLENE TEREPHTHALATE/ INSULATING ADHESIVE LAYER = THICKNESS OF 23 μm/THICKNESS OF 41 μm |
| NONWOVEN FABRIC | HIMELON N9592E AVAILABLE FROM AMBIC CO., LTD. THICKNESS OF 0.45 mm |
| GROUND FOIL | AL7080 AVAILABLE FROM SONY CHEMICAL & INFORMATION DEVICE CORP. ALUMINUM LAYER/ACRYLIC ADHESIVE LAYER = THICKNESS OF 30 μm/ THICKNESS OF 10 μm |
| SHIELD MEMBER | SF-FC700 AVAILABLE FROM TATSUTA SYSTEM ELECTRONICS CO., LTD. POLYETHYLENE TEREPHTHALATE/SILVER LAYER/CONDUCTIVE ADHESIVE LAYER = THICKNESS OF 9 μm/THICKNESS OF 0.1 μm/THICKNESS OF 20 μm |
| CONDUCTOR PITCH | 0.5 mm |
| NUMBER OF PINS | 20 pin |
| CABLE LENGTH | 500 mm |

TABLE 2

| MATERIAL | SPECIFICATION |
|---|---|
| CONDUCTOR | TIN-PLATED SOFT COPPER WIDTH OF 0.25 mm × THICKNESS OF 0.040 mm |
| INSULATOR | F2100 AVAILABLE FROM SONY CHEMICAL & INFORMATION DEVICE CORP. POLYETHYLENE TEREPHTHALATE/ INSULATING ADHESIVE LAYER = THICKNESS OF 23 μm/THICKNESS OF 41 μm |
| NONWOVEN FABRIC | NOMEX NX411 AVAILABLE FROM TEIKOKU SEN-1 CO., LTD. THICKNESS OF 0.185 mm |
| GROUND FOIL | AL7080 AVAILABLE FROM SONY CHEMICAL & INFORMATION DEVICE CORP. ALUMINUM LAYER/ACRYLIC ADHESIVE LAYER = THICKNESS OF 30 μm/ THICKNESS OF 10 μm |
| SHIELD MEMBER | SF-FC700 AVAILABLE FROM TATSUTA SYSTEM ELECTRONICS CO., LTD. POLYETHYLENE TEREPHTHALATE/ SILVER LAYER/CONDUCTIVE ADHESIVE LAYER = THICKNESS OF 9 μm/THICKNESS OF 0.1 μm/THICKNESS OF 20 μm |
| CONDUCTOR PITCH | 0.5 mm |
| NUMBER OF PINS | 21 pin |
| CABLE LENGTH | 500 mm |

Particularly, the flexible flat cable was produced as a first example based on the specifications as illustrated in Table 1, and cellulose non-woven fabrics impregnated with a flame-resistant agent were used as the first and second non-woven fabrics 14, 15. Another flexible flat cable was produced as a second example based on the specifications as illustrated in Table 2, and aromatic aramid non-woven fabrics were used as the first and second non-woven fabrics 14, 15.

Figure 4:
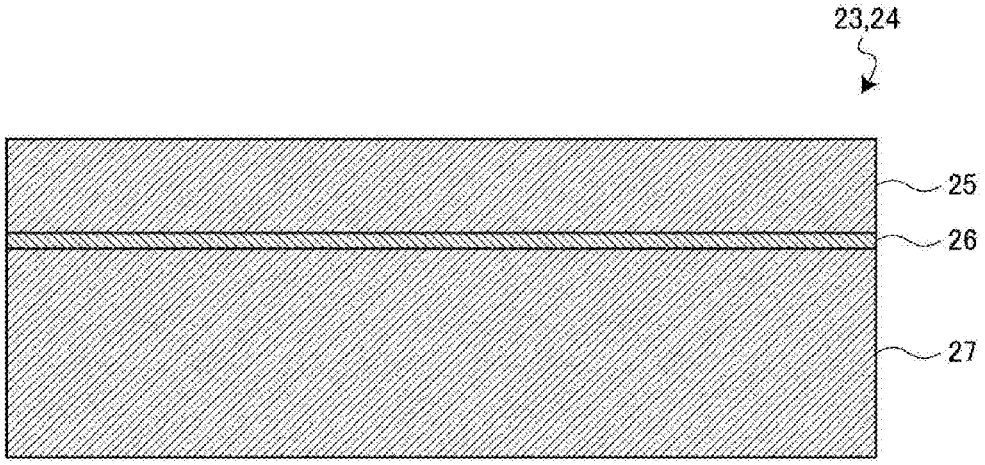
FIG. 4 is another schematic cross-sectional diagram illustrating the first ground foil and the second ground foil disposed in the flexible flat cable according to the embodiment.

More particularly, in the flexible flat cable produced as the first example, the conductors 11 were arranged in parallel with 0.5 mm pitch. Each of the conductors 11 had a width of 0.25 mm and a thickness of 0.040 mm (0.25 mm×0.040 mm), and was made of soft copper plated with tin on a surface thereof. Each of the first and second insulating members 12, 13 was produced with an insulating member "F2100" available from Sony Chemical & Information Device Corporation. The insulating member "F2100" had a total thickness of 64 μm, and was formed by laminating an insulating adhesive layer having a thickness of 41 μm on a low dielectric material made of polyethylene terephthalate having holes each of which had a thickness of 23 μm. Each of the first and second non-woven fabrics 14, 15 was produced with Himelon (trademark) ULA-E series "N9592E" having a thickness of 0.45 mm available from Ambic Co., Ltd. Each of the first and second ground foils 18, 19 was produced with a ground foil "AL7080" available from Sony Chemical & Information Device Corporation. The ground foil "AL7080" had a total thickness of 40 μm, and was formed by laminating the metal layer 20 made of aluminum having a thickness of 30 μm and the acrylic adhesive layer 21 having a thickness of 10 μm as described above with reference to FIG. 3. Each of the first and second shield members 23, 24 was produced with a shield member "SF-FC700" available from Tatsuta System Electronics Co., Ltd. The shield member "SF-FC700" had a total thickness of 29.1 μm, and was formed by providing the conductive adhesive layer 27 having a thickness of 20 μm to the bottom layer of the vapor-deposited silver shield member formed by vapor deposition of the silver layer 26 having a thickness of 0.1 m to the polyethylene terephthalate film 25 having a thickness of 9 μm as described above with reference to FIG. 4. The materials with such specifications were used to produce the flexible flat cable having 20 pins and a cable length of 500 mm.

Each of the Himelon (trademark) ULA-E series used as the first and second non-woven fabrics 14, 15 was rated as V-0 in a vertical flame test "UL94" know as the most strict flammability standard among UL standards evaluated by Underwriters Laboratories, U.S.A. Each of the Himelon (trademark) ULA-E series used as the first and second non-woven fabrics 14, 15 corresponded to the RoHS Regulations (6 substances), and could serve as a material capable of being applied to an industrial material field having strict environment regulations in workability, air permeability, shock absorbability, and dimensional stability. The specifications of such ULA-E series "N9592E" included a weight per unit area of 100 g/m$^2$, a tensile strength of 85N/5 cm in a MD direction, and a tensile strength of 70N/5 cm in a CD direction.

In the flexible flat cable produced as the second example, the materials used as the conductors 11, the first and second insulating members 12, 13, the first and second ground foils 18, 19, and the first and second shield members 23, 24 were substantially the same as these of the flexible flat cable produced as the first example. Each of the first and second non-woven fabrics 14, 15 was produced with NOMEX (trademark) "NX411" having a thickness of 0.185 mm available from Teikoku Sen-I Co., Ltd. The materials with such specifications were used to produce the flexible flat cable having 21 pins and a cable length of 500 mm.

The NOMEX (trademark) used as each of the first and second non-woven fabrics 14, 15 was a non-woven fabric of meta-system aramid fiber obtained from co-condensation polymerization of m-phenylenediamine and isophthalic chloride, and had good fire resistance and heat resistance. The NOMEX (trademark) of type 411 was produced by dispersing flock (staple fiber) and fibid (synthetic pulp) produced from aramid polymer in the water and applying in a paper machine. The NOMEX (trademark) of type 411 was rated as V-0 in the vertical flame test "UL94" know as the most strict flammability standard among UL standards. The specifications of such NOMEX (trademark) type 411 (250 μm thickness) included a weight per unit area of 0.51 kg/cm$^2$, a tensile strength of 5.0 kg/15 mm in a MD direction, and a tensile strength of 2.9 kg/15 mm in a XD direction.

Such flexible flat cables serving as the first example and the second example were produced by a method described below.

The Himelon (trademark) ULA-E series "N9592E" or NOMEX (trademark) "NX411" serving as the first and second non-woven fabrics 14, 15 and the double-sided adhesive layers 16, 17 serving as the double-sided tape were adhered using a roller, and were laminated at 120 degrees Celsius. The non-woven fabrics and the double-sided tape members laminated were cut in a width that was substantially the same as the transmission path width of the cable body 10. Herein, the cable body 10 was produced beforehand using the conductors 11 and the first and second insulating members 12, 13 with the specifications described above.

Subsequently, the non-woven fabrics and the double-sided tape members cut were adhered to both sides of the cable body 10 using the roller, and were laminated at 120 degrees Celsius. The first and second ground foils 18, 19 with the above specifications were adhered using the roller to the terminal portions at both ends of the cable body 10 laminated.

Moreover, the both surfaces of the cable body 10 having the ground foils were covered with the first and second shield members 23, 24 with the above specifications. Herein, a deaeration effect could be obtained by ironing in a case of a provisional adhesion process.

The cable body 10 having the shield members were laminated at 120 degrees Celsius using a wrinkle defense jig, and further laminated at 120 degrees Celsius, thereby producing the flexible flat cables.

The two types of the flexible flat cables were produced by the above method, and differential impedances thereof were measured by the inventors of the present invention using a time domain reflectometry (TDR) method. Herein, the TDR method represents a method for measuring an electromagnetic wave in a high frequency band between 1 MHz and 30 GHz and displaying the wave on a time axis. The measurements were conducted using a TDR measurement device (Model: TDS8000B) and a TDR module (Model: 80E04) available from Tektronix. The differential impedance to be targeted was 100Ω+/−15%. The measurement result of the flexible flat cable produced as the first example is illustrated in FIG. 6 while the measurement result of the flat cable produced as the second example is illustrated in FIG. 7.

Figure 6:
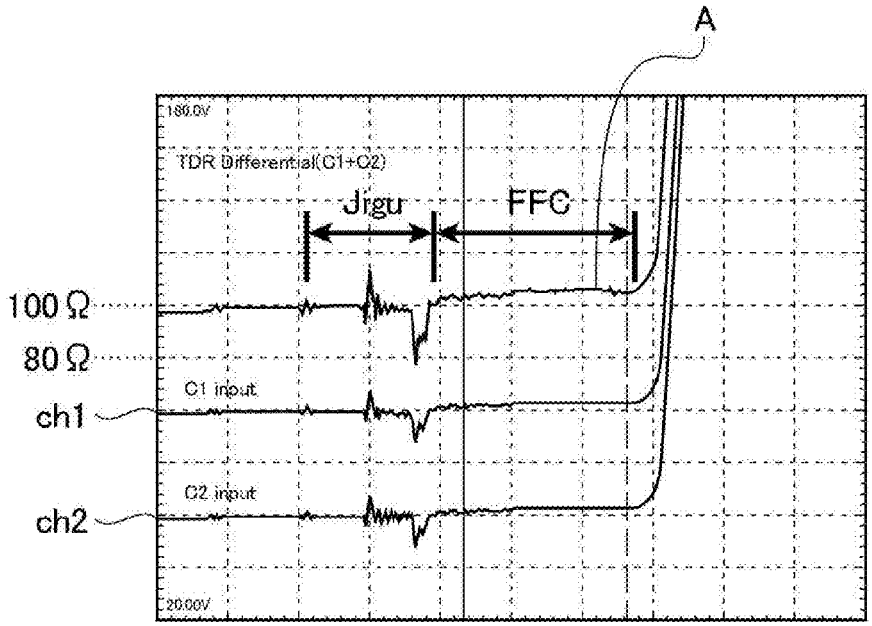
FIG. 6 is a schematic diagram illustrating a measurement result of a differential impedance of the flexible flat cable produced according to the first example.

The flexible flat cable produced as the first example had the differential impedance of 104Ω in a case of inputting a two-system of signals ch1 and ch2 as indicated by a line "A" shown in FIG. 6. Therefore, the flexible flat cable produced as the first example was confirmed that the target of 100Ω+/−15% was satisfied therewith.

Figure 7:
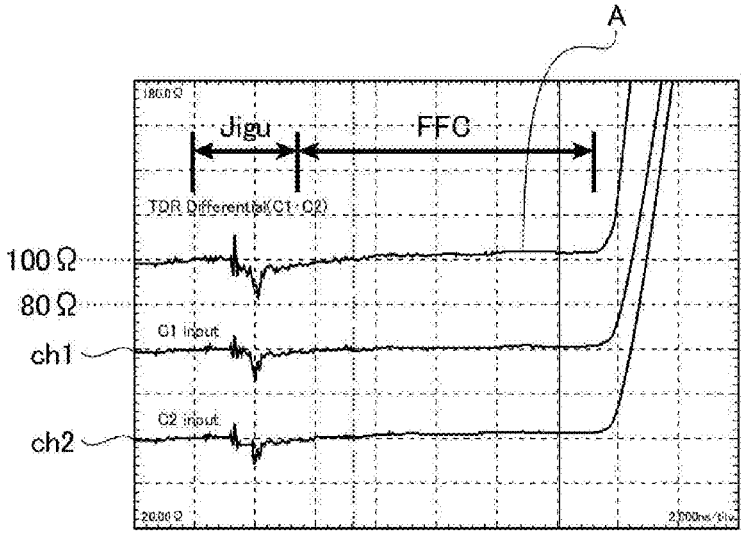
FIG. 7 is a schematic diagram illustrating a measurement result of a differential impedance of a flexible flat cable produced according to a second example.
Figure 8:
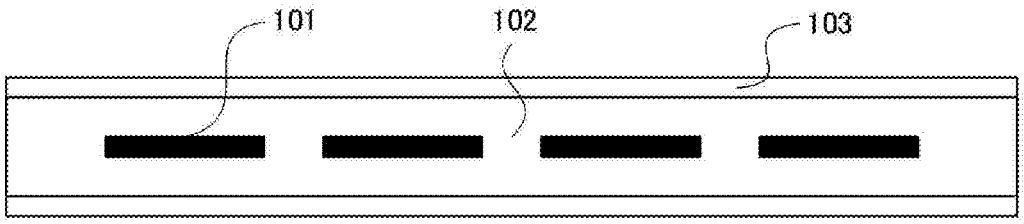
FIG. 8 is a cross-sectional view illustrating a prior art flexible flat cable.
Figure 8:
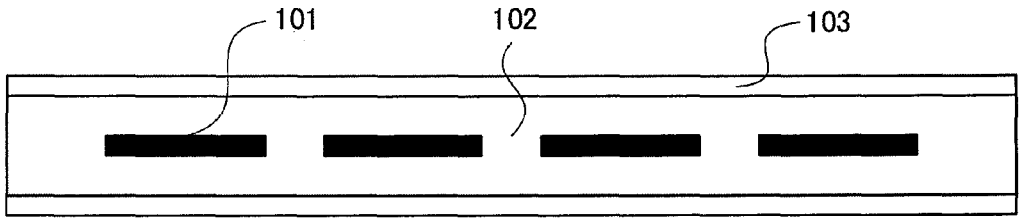
Prior Art FIG. 8
Figure 9:
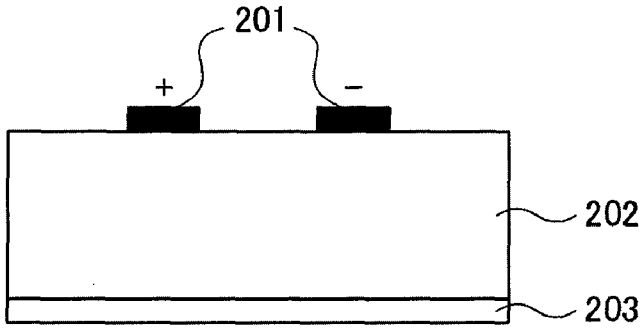
Prior Art FIG. 9
FIG. 9 is a cross-sectional view illustrating a flexible flat cable with a microstrip structure.
Figure 10:
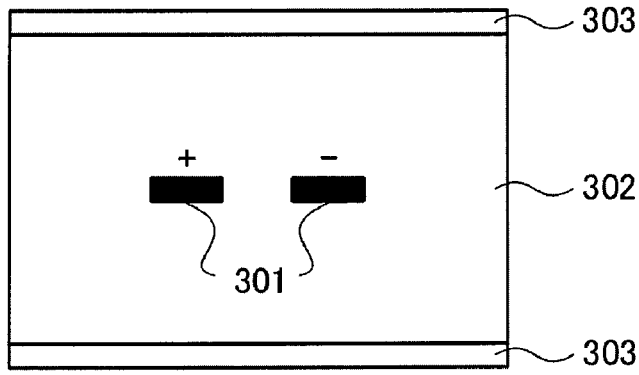
Prior Art FIG. 10
FIG. 10 is a cross-sectional view illustrating a flexible flat cable with a strip structure.
Figure 11:
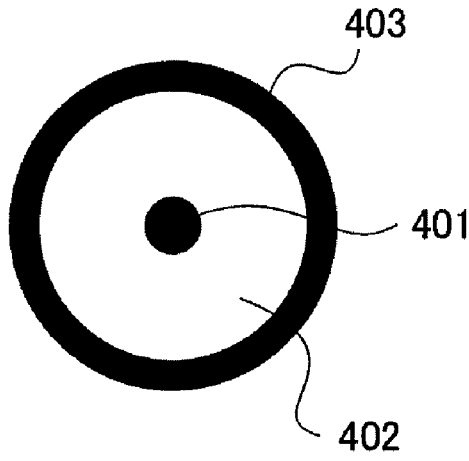
Prior Art FIG. 11
FIG. 11 is a cross-sectional view illustrating an extra-fine coaxial cable.
Figure 12:
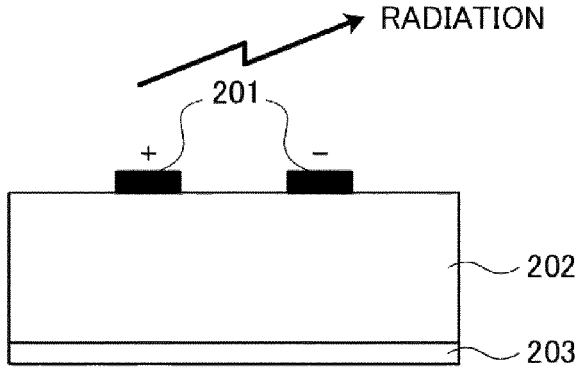
FIG. 12 is a cross-sectional view illustrating a problems of the flexible flat cable with the microstrip structure.
Figure 13:
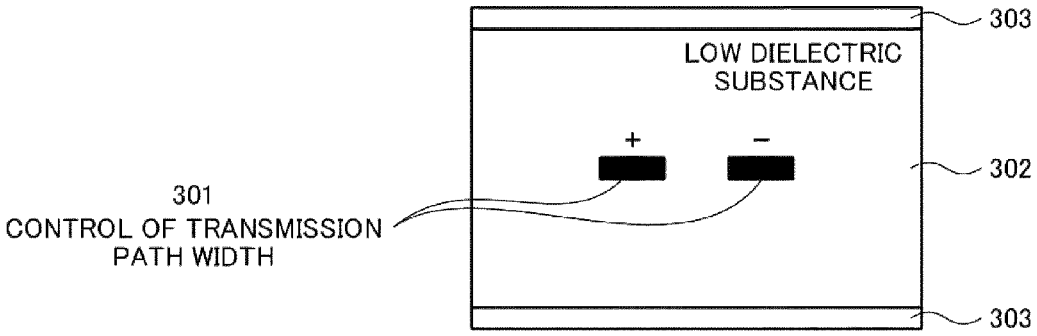
FIG. 13 is a cross-sectional view illustrating a problem of the flexible flat cable with the strip structure.

The flat cable produced as the second example, on the other hand, had the differential impedance of 101Ω in a case of inputting the two-system of signals ch1 and ch2 as indicated by a line "A" shown in FIG. 7. Therefore, the flexible flat cable produced as the second example was confirmed that the target of 100Ω+/−15% was satisfied therewith.

Therefore, the flexible flat cable optionally adjusts the dielectric constant by changing the width and the thickness of the conductor 11 and the thickness of each of the first and second non-woven fabrics 14, 15 as needed, thereby providing a desirable characteristic impedance and differential impedance. Moreover, the inventors of the present invention confirmed that the flexible flat cables produced could satisfy a standard "HB" as a result of the vertical flame test according to "UL94."

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A flat cable comprising:

a cable body including a plurality of conductors arranged with a prescribed pitch therebetween, and a pair of first insulating members sandwiching the conductors;

air-containing layers, serving as second insulating members, having a width substantially the same as a transmission path width of the cable body, the air-containing layers being formed on the first insulating members and disposed to sandwich the cable body from both sides, the second insulating members being made of a material different than the first insulating members; and a shield member disposed to cover surfaces of the air-containing layers and to be conductively connected to a ground layer at terminal portions of both ends of the cable body, wherein the air-containing layers include a non-woven fabric cut in a width substantially the same as the transmission path width of the cable body.

2. The flat cable according to claim 1, wherein the non-woven fabric has flame-resistance.

3. The flat cable according to claim 2, the non-woven fabric includes cellulose or aromatic aramid impregnated with a flame-resistant agent.

4. The flat cable according to claim 3, wherein the shield member includes a conductive adhesive layer disposed as a bottom layer of a vapor-deposited metal shield member formed by vapor deposition of a metal layer serving as a shield layer to a base film, and is adhered in such a manner as to be conductively connected to the ground layer through the conductive adhesive layer.

5. The flat cable according to claim 4, wherein the metal layer is a silver layer.

6. The flat cable according to claim 3, wherein the ground layer is provided by laminating a ground metal layer and an adhesive layer, and is adhered from an end portion of the non-woven fabric to the terminal portion of the cable body through the adhesive layer.

7. The flat cable according to claim 3, wherein each of the plural conductors is made of soft copper plated with prescribed metal on a surface thereof.

8. The flat cable according to claim 2, wherein the shield member includes a conductive adhesive layer disposed as a bottom layer of a vapor-deposited metal shield member formed by vapor deposition of a metal layer serving as a shield layer to a base film, and is adhered in such a manner as to be conductively connected to the ground layer through the conductive adhesive layer.

9. The flat cable according to claim 8, wherein the metal layer is a silver layer.

10. The flat cable according to claim 2, wherein the ground layer is provided by laminating a ground metal layer and an adhesive layer, and is adhered from an end portion of the non-woven fabric to the terminal portion of the cable body through the adhesive layer.

11. The flat cable according to claim 2, wherein each of the plural conductors is made of soft copper plated with prescribed metal on a surface thereof.

12. The flat cable according to claim 1, wherein the shield member includes a conductive adhesive layer disposed as a bottom layer of a vapor-deposited metal shield member formed by vapor deposition of a metal layer serving as a shield layer to a base film, and is adhered in such a manner as to be conductively connected to the ground layer through the conductive adhesive layer.

13. The flat cable according to claim 12, wherein the metal layer is a silver layer.

14. The flat cable according to claim 1, wherein the ground layer is provided by laminating a ground metal layer and an adhesive layer, and is adhered from an end portion of the non-woven fabric to the terminal portion of the cable body through the adhesive layer.

15. The flat cable according to claim 14, wherein the ground metal layer is an aluminum layer.

16. The flat cable according to claim 1, wherein each of the plural conductors is made of soft copper plated with prescribed metal on a surface thereof.

17. The flat cable according to claim 1, wherein the first insulating members include a porous polyethylene terephthalate layer laminated on an insulating adhesive layer.

18. The flat cable according to claim 17, wherein the insulating adhesive layer includes a material selected from the group consisting of epoxy resin, acrylic resin, melamine resin, polyamide resin, and polyimide resin.

19. The flat cable according to claim 1, wherein the ground layer is formed to cover a portion of one of the air-containing layers.

20. The flat cable according to claim 1, wherein the air-containing layers are cellulose non-woven fabrics.

21. The flat cable according to claim 1, wherein the air-containing layers are aromatic aramid non-woven fabrics.

* * * * *